United States Patent [19]

Mohrbach

[11] 4,373,413

[45] Feb. 15, 1983

[54] PUNCH PRESS APPARATUS FOR PLACEMENT AND ALIGNMENT OF A KNIFE HOLDER

[75] Inventor: Hans Mohrbach, Rieschweiler, Fed. Rep. of Germany

[73] Assignee: Ernst Mohrbach KG, Rieschweiler, Fed. Rep. of Germany

[21] Appl. No.: 215,078

[22] Filed: Dec. 10, 1980

[30] Foreign Application Priority Data

Dec. 22, 1979 [DE] Fed. Rep. of Germany ..... 2952010

[51] Int. Cl.[3] ..... B26F 1/38

[52] U.S. Cl. ..... 83/123; 83/137; 83/532; 83/545; 83/561; 83/698; 83/DIG. 1

[58] Field of Search ..... 83/532, 561, 653, 137, 83/123, 698, 545, DIG. 1

[56] References Cited

U.S. PATENT DOCUMENTS

| | | | |
|---|---|---|---|
| 58,315 | 9/1866 | Stearns | 83/532 |
| 955,245 | 4/1910 | Zimmerman | 83/532 |
| 2,401,800 | 6/1946 | Ryan | 83/532 |
| 2,785,746 | 3/1957 | Mathews | 83/532 |
| 3,045,521 | 7/1962 | Eisenberg | 83/532 |
| 3,555,949 | 1/1971 | Treff | 83/561 X |
| 3,987,696 | 10/1976 | Haas et al. | 83/532 |

*Primary Examiner*—Frank T. Yost

*Attorney, Agent, or Firm*—Toren, McGeady and Stanger

[57] ABSTRACT

In apparatus for the placement and alignment of punch knives mounted in a knife holder on a punch press, a first swivel arm is pivotally supported at one end on a support for pivotal movement about a vertical axis. A second swivel arm is supported on the other end of the first swivel arm. The second swivel arm is a double-armed parallelogram member pivotally movable about a vertical axis and about horizontal axes at each of the opposite ends. A knife holder is pivotally connected to the parallelogram member at the opposite end from the first swivel arm. Due to the pivotal support of the two swivel arms and the pivotal connection of the knife holder, the knife holder can be moved along horizontal and vertical coordinates. A return member is associated with the second swivel arm for returning it into the horizontal position after the completion of a punching operation.

7 Claims, 4 Drawing Figures

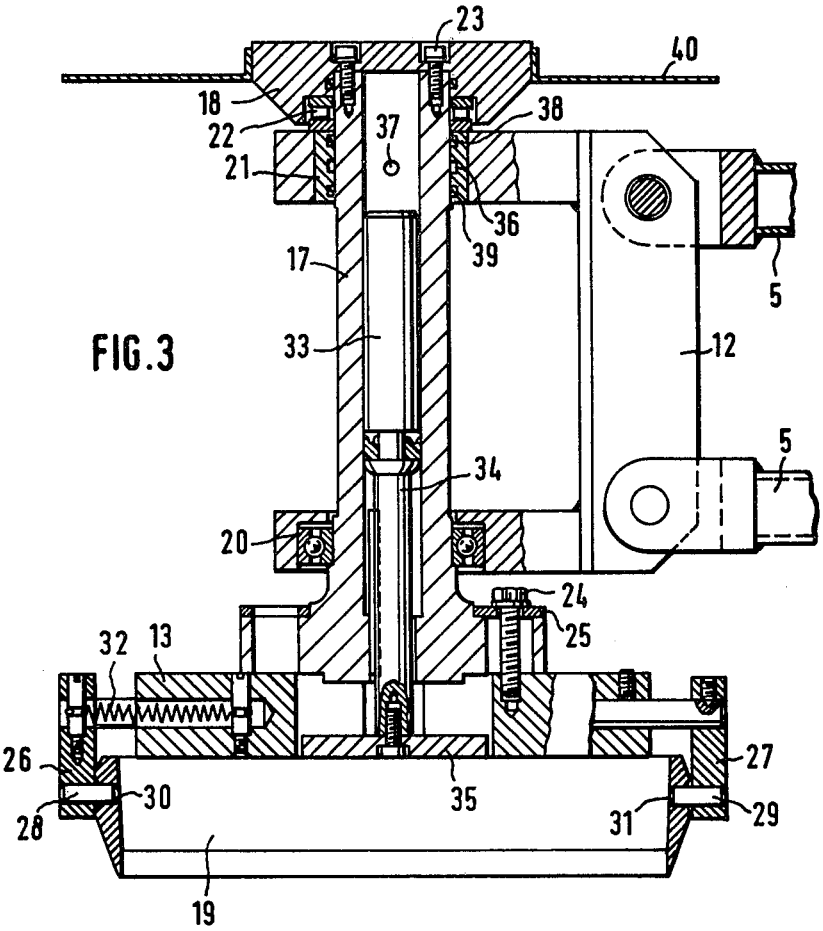
FIG.3
FIG.4
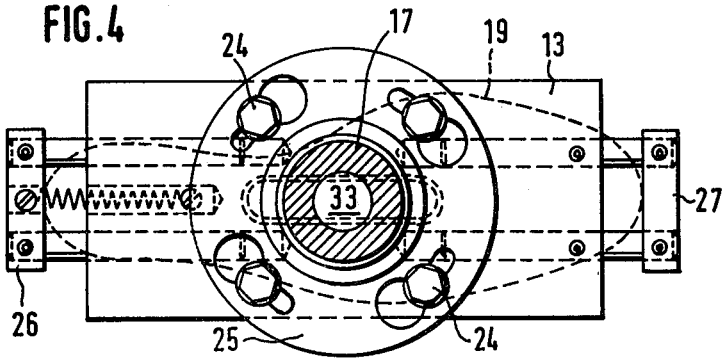

PUNCH PRESS APPARATUS FOR PLACEMENT AND ALIGNMENT OF A KNIFE HOLDER

SUMMARY OF THE INVENTION

The present invention is directed to a punch press apparatus for the placement and alignment of a knife holder arranged to mount the punch knives.

To prevent accidents during the operation of a punch press in which knives punch blanks out of a flat material, care must be exercised that the punching stroke is actuated only after the operator has removed both hands out of the region of the knives, or the knives must be located at such a height, (in Germany 10 cm. are required) that during accidental premature release of the punching stroke the operator's hands still in the region of the knives or punching tool cannot be crushed. In this second arrangement, it is not possible to prevent completely any injury to the operator, particularly to his fingers, which may occur due to carelessness.

Further, the working sequence is relatively slow so that it has not been possible to develop any significant output capacity. With such relatively slow operation, an operator may tend to move too quickly so that carelessness handling results in injuries.

Therefore, it is the primary object of the present invention to provide a punch press apparatus which permits the punch knives to be quickly positioned and aligned with the apparatus being arranged so that operator injury can be avoided.

In accordance with the present invention, punch press apparatus is provided for the placement and alignment of punch knives. The apparatus includes a first and a second swivel arm. The first swivel arm is connected to a support and the second swivel arm is connected to the opposite end of the first swivel arm from the support. A knife holder for the punch knives is attached to the end of the second swivel arm spaced from the first swivel arm.

The second swivel arm which mounts the knife holder is preferably constructed as a double-armed parallelogram arm.

A restoring force can be incorporated into the swivel arms in the form of a return spring. Alternatively, the restoring force could be provided by a pneumatic cylinder. By means of the restoring force there is the advantage that by means of an appropriate control, the punch knife can be easily lifted after the punch stroke. In addition, by maintaining a constant pressure, the different weights of the knife holder including the punch knife can be balanced out.

The knife holder is equipped with knife gripping devices which secure the punch knife in an exchangeable and locked manner. Further, the knife holder is equipped on the opposite side from the knife with an anvil directed against a support beam of the punch press.

Advantageously, the knife holder and the anvil are connected by a vertically extending tubular handle. The handle also serves as a support for connecting the double-armed parallelogram arm to the knife holder.

The handle may also incorporate a hydraulic cylinder having a downwardly displaceable piston with an ejection plate so that, after a punching stroke has been completed, the ejection plate can be moved downwardly for ejecting the punched out blank either into an available container or onto a conveying device.

Preferably, the knife-gripping devices are equipped with a return spring so that a punch knife can be fixed in position very quickly.

To effect the quick replacement of punch knives of very different sizes and shapes in the knife holder, a snap closure, perhaps in the form of known clamping plates used with machine tools, can be positioned between the knife holder and the handle. If necessary, an additional protective plate can be provided between the handle and the anvil.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE INVENTION

In the drawing:

FIG. 3 is an enlarged side view, partly in section, of a portion of the apparatus shown in FIG. 1; and FIG. 4 is a plan view of the knife holder illustrated in FIG. 3.

DETAIL DESCRIPTION OF THE INVENTION

Figure 1:
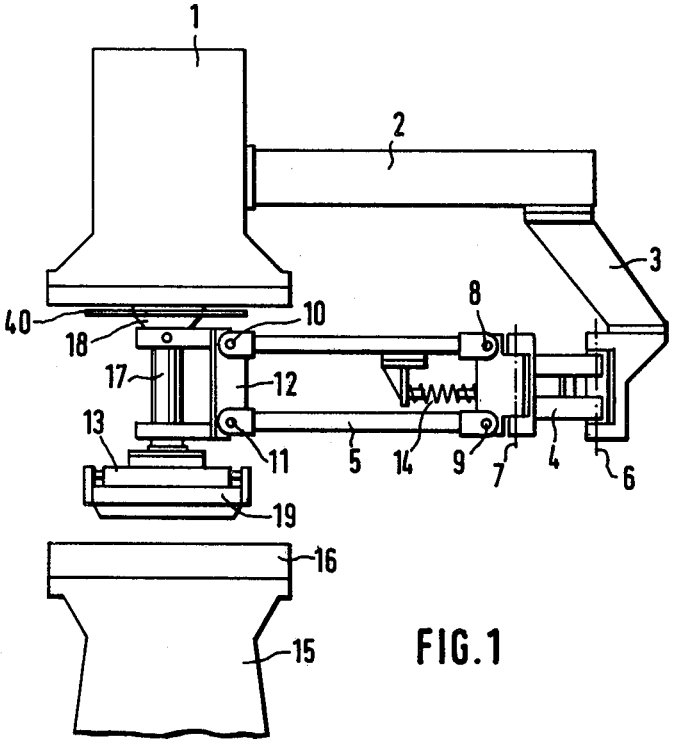
FIG. 1 is a side elevational view of a bridge punch press incorporating apparatus embodying the present invention.

The movable punching portion of a punch press is supported from a beam 1 of a bridge punch press and a supporting arm 2 is cantilevered out from the beam 1. A spacer member 3 extends downwardly from the outer end of the arm 2 and a horizontally arranged double-armed first swivel arm 4 is mounted on the lower end of the spacer 3 for pivotal movement about a vertical axis 6. A second swivel arm 5 in the form of a double-armed parallelogram arm is pivotally supported on the end of the first swivel arm spaced outwardly from the spacer 3. While first swivel arm 4 can be pivoted about a vertical axis 6, the second swivel arm or parallelogram arm 5 can be pivoted about the vertical axis 7 and also about the horizontal pivot axes 8, 9. At the opposite end of the second swivel arm 5 from the first swivel arm 4, a knife holder 13 is pivotally mounted on the second swivel arm about the horizontal pivot axes 10, 11 by means of a U-shaped intermediate piece 12. The knife holder 13 always maintains the necessary horizontal position independent of the position of the second swivel arm 5. In other words, knife holder 13 is pivotally supported via the intermediate piece 12 about the horizontal pivot axes 10 and 11 so that it remains in the horizontal position through the second swivel arm 5 is displaced out of the horizontal position shown in FIG. 1 during the punching operation.

A restoring device, a spring 14 as shown in FIG. 1, is located within the second swivel arm 5 and serves to return the second swivel arm into its initial horizontal position after the completion of a punching operation.

In place of the spring 14, a pneumatic cylinder can be used which effects the same restoring action as that of the spring 14. Further, the cylinder can be controlled so that it supports the return of the punch tool into its initial position after the completion of a punch stroke. Finally, the cylinder can also be used to balance out the different weights of the knives or punch tools.

As is customary, spaced below the support beam 1 of the punch press is the press base 15 and a punch support 16. U-shaped intermediate piece 12 spans a vertically extending, hollow cylindrical member 17 which serves primarily as a handle. At its lower end, member 17 carries the knife holder 13 and an anvil 18 is located at its upper end interacting with the punch beam 1.

Punch knife 19 is fitted into the knife holder 13. When the punch knife 19 is in place, the second swivel arm 5 forms an angle with the horizontal and a corresponding space results between the punch beam 1 and the anvil 18.

Figure 2:
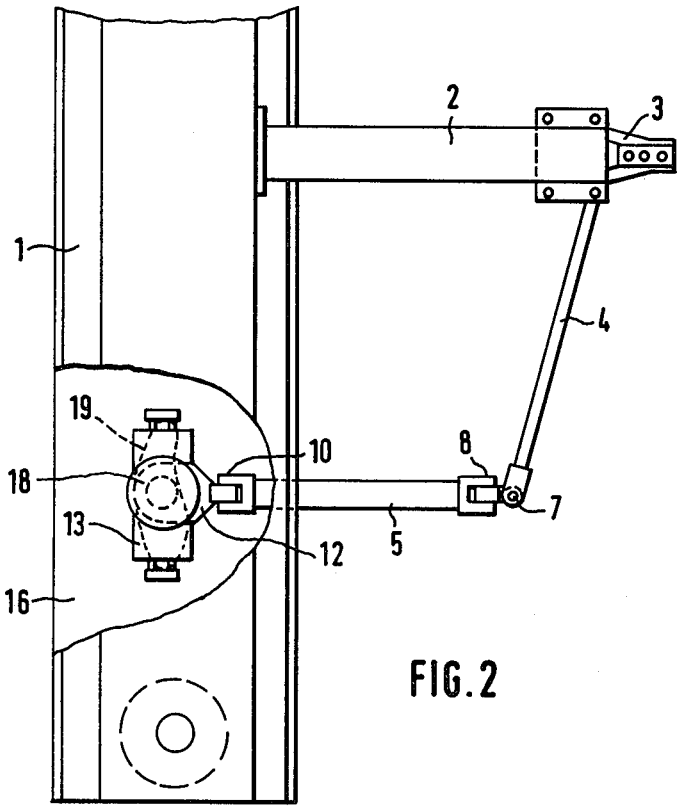
FIG. 2 is a plan view of the apparatus shown in FIG. 1 with a portion of the support structure broken away.

A plan view of the apparatus illustrated in FIG. 1 is shown in FIG. 2. A portion of the punch beam 1 is broken away above the punch means. Further, knife holder 13 is rotated through 90° as compared to the arrangement shown in FIG. 1.

Additional details of the apparatus are provided in FIG. 3. The member or handle 17 is supported in the U-shaped intermediate piece 12 by means of a lower radial ball-bearing 20 and an upper bushing 21. Bushing 21 rides against an axial roller bearing 22 held in the lower end of the anvil 18. Anvil 18 is secured by means of bolts 23 to the upper end of the member 17.

Knife holder 13 is secured to the lower end of the handle 17 by bolts 24 and a snap closure plate 25. Knife holder 13 has knife gripping devices 26, 27 including pegs 28 and 29 which fit into corresponding openings 30, 31 in the sides of the punch knife 19. Gripping device 26 is acted on by the biasing action of spring 32. The exchange of punch knives of different sizes can be carried quickly without any problems. If punch knives of greatly different sizes and shapes are used, however, then the knife holder can be quickly and simply replaced via the snap closure formed by the bolts 24 and the snap closure plate 25.

It is possible to replace the illustrated knife holder 13 with another holding member, for instance, a magnetic plate.

In the illustrated embodiment, the hollow space within the member 17 forms a hydraulic cylinder having a piston 34 at its lower end with an ejection plate 35 attached to the lower end of the piston. The hollow space in cylinder 33 above the piston 34 is supplied with hydraulic medium via an annular duct 36, located in the bushing 21. At least one opening 37 leads from the annular duct 36 into the cylinder 33. The exterior hydraulic connection is not shown. The hydraulic medium exits from the cylinder 33 through two seals 38, 39 in the bushing 21.

It is advantageous in the automatic or manual operation of the ejection plate 35 that the punch apparatus is located laterally outwardly from the edge of the punch support 16 so that the blank punched out of the flat material can be deposited in a container or on a conveyor means for removal.

A protective plate 40, note FIGS. 1 and 3, is located around the sides of the anvil 18.

The apparatus embodying the present invention permits a very simple, rapid, energy saving and especially safe operation of a punch press.

What is claimed is:

1. Apparatus for the placement and alignment of punch knives on material to be punched in a punch press, comprising a support, a first swivel arm having a first end and a second end with the first end pivotally attached to said support for pivotal movement about a vertical axis, a second swivel arm having a first end and a second end with the first end pivotally attached to the second end of said first swivel arm for pivotal movement about a vertical axis, said second swivel arm being pivotally mounted for pivotal movement about a horizontal axis, and a knife holder pivotally attached to the second end of said second swivel arm, said knife holder supported by said first and second swivel arms for movement along horizontal and vertical coordinates, said second swivel arm comprises a double-armed parallelogram arm with each arm of said double-armed parallelogram arm pivotal about a separate horizontal axis, means for effecting a restoring force on said swivel arm for returning said swivel arm to a horizontal position after it is displaced during a punching operation, said knife holder includes a tubular vertically aligned member extending upwardly from said knife holder, said second swivel arm is pivotally connected to said member, said tubular member forming a cylinder therein, a piston located in the lower end of said cylinder, an ejection plate secured to the lower end of said piston exteriorly of said cylinder, and means in communication with said cylinder for supplying a hydraulic medium thereto for displacing said piston and said ejection plate in the downward direction.

2. Apparatus, as set forth in claim 1, wherein said restoring force means comprises a return spring mounted in said second swivel arm.

3. Apparatus, as set forth in claim 1, wherein said restoring means comprises a pneumatic cylinder located in said second swivel arm for equalizing the weight of said knife holder and any punch knife mounted thereon as well as effecting the restoring force on said second swivel arm.

4. Apparatus, as set forth in claim 1, wherein said knife holder includes knife gripping members for the exchangeable attachment of a punch knife on said knife holder.

5. Apparatus, as set forth in claim 4, including an anvil located between said knife holder and said support.

6. Apparatus, as set forth in claim 5, including a protective plate laterally encircling said anvil about the upper end of said member.

7. Apparatus, as set forth in claim 1, including a snap closure for securing said knife holder on the lower end of said member, and said snap closure including a clamping plate fitted onto the lower end of said member.

* * * * *